US010874214B2

(12) United States Patent
Cattaneo

(10) Patent No.: US 10,874,214 B2
(45) Date of Patent: Dec. 29, 2020

(54) COMPACT FRONT REGULATION SYSTEM FOR LEVELING FEET FOR FURNITURE

(71) Applicant: Leonardo S.r.l., Figino Serenza (IT)

(72) Inventor: Carlo Cattaneo, Figino Serenza (IT)

( * ) Notice: Subject to any disclaimer, the term of this patent is extended or adjusted under 35 U.S.C. 154(b) by 0 days.

(21) Appl. No.: 16/810,733

(22) Filed: Mar. 5, 2020

(65) Prior Publication Data

US 2020/0196756 A1 Jun. 25, 2020

Related U.S. Application Data

(63) Continuation of application No. 16/065,707, filed as application No. PCT/EP2017/054439 on Feb. 27, 2017, now Pat. No. 10,638,839.

(30) Foreign Application Priority Data

Mar. 9, 2016 (IT) ..... 102016000024683

(51) Int. Cl.
*A47B 91/02* (2006.01)

(52) U.S. Cl.
CPC ..... *A47B 91/028* (2013.01)

(58) Field of Classification Search
CPC ..... A47B 91/028; A47B 91/02; F16M 11/24
USPC ..... 248/188.1, 188.2, 188.3, 188.4, 188.5
See application file for complete search history.

(56) References Cited

U.S. PATENT DOCUMENTS 4,991,805 A * 2/1991 Solak ..... F16M 7/00 248/188.4
5,398,620 A * 3/1995 Rouch ..... F16M 7/00 108/1
2007/0205342 A1* 9/2007 Gabriel ..... F16M 7/00 248/188.4
2010/0276564 A1* 11/2010 Fetzer ..... D06F 39/125 248/678
2017/0273458 A1* 9/2017 Sickles ..... A47B 91/005
2019/0110596 A1* 4/2019 Browne ..... A47B 91/16
2019/0281981 A1* 9/2019 Cattaneo ..... A47B 91/028

FOREIGN PATENT DOCUMENTS

AU 2009227484 A1 * 5/2010 ..... A47B 91/02

* cited by examiner

*Primary Examiner* — Muhammad Ijaz
(74) *Attorney, Agent, or Firm* — Themis Law

(57) ABSTRACT

A compact front regulation system for leveling feet of furniture pieces having a bottom and shoulders includes, in combination, at least one front foot and at least one rear foot, the at least one rear foot having a regulation mechanism in height which is accessible from the outside and which can be maneuvered using a regulation tool. The at least one front foot has a pass-through hole for the regulation tool of the rear foot, the pass-through hole acting as a support and a guide for the regulation tool.

10 Claims, 9 Drawing Sheets

M
49
123
23
26
11
42
43
25
41'
24
29
28
47
30
48
12
35
27
44
45

41'
47
28
26
24
24
30

41'
28
47
26
30
24
24

30
41'
28
47
XIV
XIV
26

41'
41'
28
47
26
24
24
30

M 42
43
42'
43'
22
25
11
12
123
45
141'
127
35
44
47
27

COMPACT FRONT REGULATION SYSTEM FOR LEVELING FEET FOR FURNITURE

FIELD OF THE INVENTION

The present invention relates to a compact front regulation system for leveling feet for furniture.

The invention is particularly suitable for effecting the adjustment of rear feet applied to the bottom of the furniture, such as for example in kitchen bases, where the distance between the bottom and the floor is minimum and limited, with difficulty in having front access to the rear feet of the system.

BACKGROUND OF THE INVENTION

Various leveling systems are known which, however, involve the provision and assembly of specific transmission rods and adjustment of the rear feet.

Due to the minimum distance between the bottom of the furniture and the floor, in fact, it is impossible to act with precision and rapidity using a screwdriver or tool that reaches the rear feet. The considerable distance and minimum space available create difficulty in having access to the holes or regulation devices of the rear feet. This leads to the necessity of having guides and extension rods controlled by a screwdriver or similar tool that are guided towards the specific seat of the rear foot. This difficulty is overcome by the provision of transmission rods, for example inside specific guides constrained to the bottom of the furniture, as described for example in EP 2839761.

These transmission rods are consequently suitably supported in specific separate tubular elements, fixed to the bottom of the furniture, which keep them guided in position and which enable the rear feet to be regulated with a normal screwdriver or tool.

The presence of separate supports entails that, in order to be installed and reach the feet, these must be arranged tilted with respect to both the actuation and foot, creating difficulty in actuation.

Alternatively, feet arranged in plaques or connections for supporting the feet are currently provided, wherein said plaques are provided with specific passages and housings specifically destined for housing the above-mentioned transmission rods towards the rear feet, as disclosed for example in Italian patent application MI2011A001872.

If, in this case, the separate supports of the transmission rods are eliminated, the supporting plaques of the front feet must in any case provide passages and housings for the transmission rods.

Furthermore, the distances necessary for the arrangement of the various parts, not always the same depending on the application, must also be envisaged.

The elements involved are, therefore, not only connections or plaques for supporting the feet, but also transmission rods that entail both production and assembly costs.

Consequently, in the current art, either numerous elements are necessary for forming and actuating the regulation system of the rear feet, or complex plaques or connections must be provided for supporting the front feet with relative rods positioned in the same in order to eliminate the supports of the transmission rods.

It should also be taken into account that not all adjustable feet provide for these separate connection plaques, but an integrated connection may be provided and consequently the adjustment should be effected in the presence of any type of foot used.

AU 2009227484 A1 and WO 2010/020633 relate to regulation systems for leveling feet and actuated with the presence of elongated rods positioned beneath the furniture to intervene on the rear feet.

SUMMARY OF THE INVENTION

The general objective of the present invention is to provide a front regulation system for rear leveling feet for furniture that is particularly simplified with respect to the currently known systems.

A further objective of the present invention is to provide a front regulation system for rear leveling feet for furniture in which the space beneath the bottom of the furniture is extremely limited with serious access difficulties.

Another objective of the invention is to provide a regulation system that is suitable for the various configurations of the rear feet used for leveling the furniture.

Yet another objective is to provide a front regulation system for rear leveling feet for furniture which does not provide any transmission rod for actuating the regulation of the rear feet of the furniture.

A further objective of the invention is to provide a regulation system for rear feet used for leveling furniture that is particularly compact and minimizes the elements forming it.

The above objectives are achieved by a system having the characteristics specified hereinafter.

BRIEF DESCRIPTION OF THE DRAWINGS

The structural and functional characteristics of the invention, and its advantages with respect to the known art, can be clearly understood from the following description, referring to the enclosed drawings, that illustrate various embodiment examples of the invention itself.

In the drawings.

DETAILED DESCRIPTION OF EMBODIMENTS OF THE INVENTION

With reference in general to the drawings, it can be seen that the figures partially illustrate a piece of furniture M, for example a piece of kitchen furniture (base), wherein, in the example shown, shoulders 11 (sides) terminate in correspondence with a bottom 12, i.e. they do not reach the floor (not shown).

In other embodiments, the shoulders 11 can reach the floor and the bottom 12 can be at a greater height with respect to the edge of the shoulders 11 that are resting on the floor.

As already indicated, in this type of furniture, the space beneath the bottom must be completely free and it may be impossible to have front access to the adjustable rear feet due to the limited distance between the floor and bottom of the furniture.

Figure 1:
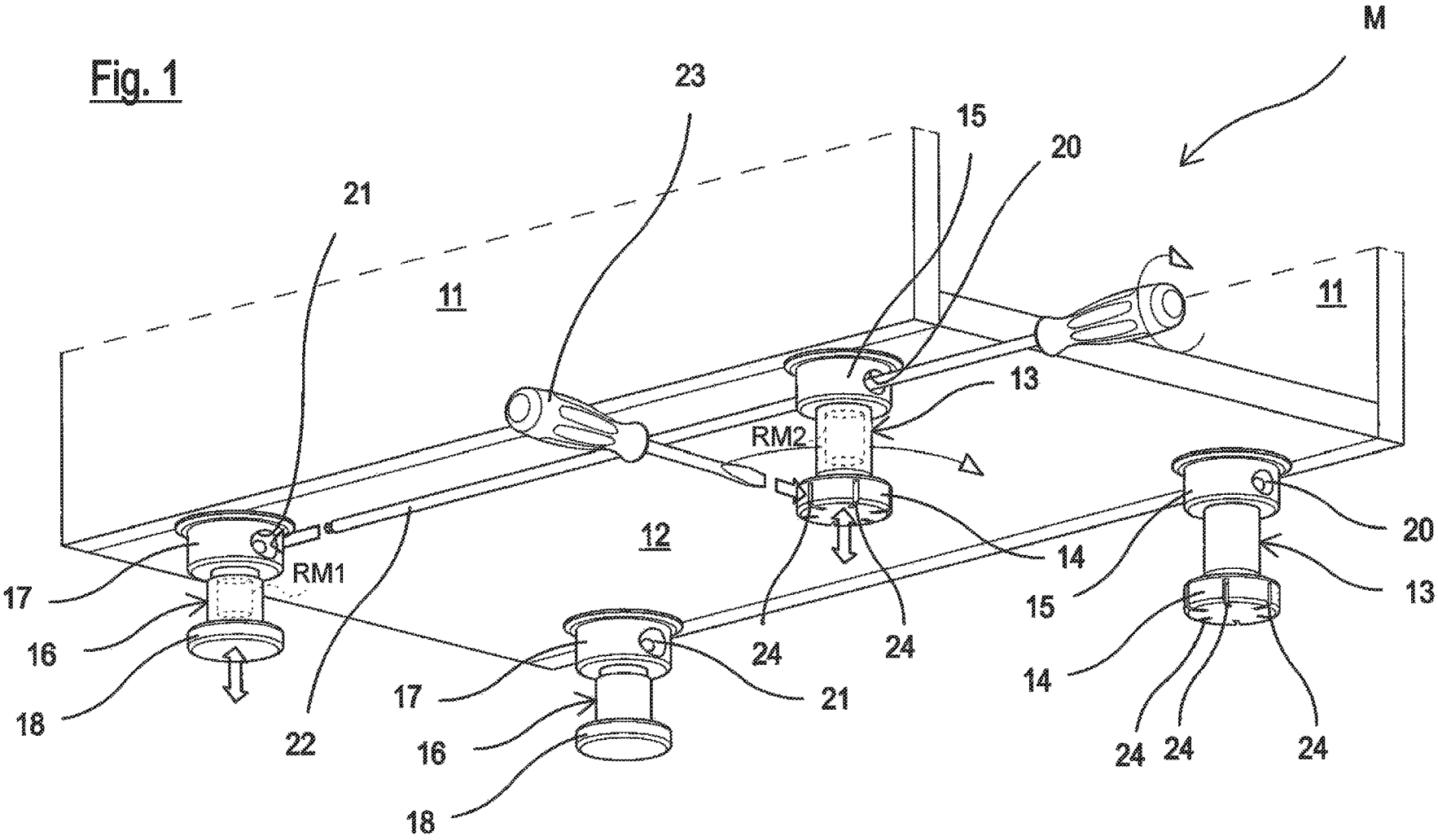
FIG. 1 is a perspective view illustrating a first example of a compact front regulation system for leveling feet for furniture produced according to the present invention with an integrated connection to the rear foot provided with a regulation mechanism.

The bottom 12 is destined, in correspondence with the corners with groups of holes (not shown), facing downwards, for the fixing of feet. More specifically, FIG. 1 shows how, in a first example, front feet 13 are fixed to the bottom 12, which are adjusted directly by rotating an adjustable lower part 14 with respect to an upper integrated connection 15. Rear feet 16, in an upper connection 17 of the same, contain a regulation mechanism in height RM1 accessible from the outside and which act on a lower supporting part 18 of the foot for adjusting its height.

According to the compact front regulation system of the present invention, the front feet 13 are provided with a pass-through hole 20 formed from one side to the other in the upper integrated connection 15. The pass-through hole 20 is preferably produced according to a central axial direction in the above-mentioned connection 15. The rear feet 16 in their upper connection 17 also provide a central hole 21 which gives access and drives the internal regulation mechanism in height RM1.

In this way, in order to effect the adjustment, a tip of a long-stemmed screwdriver 22 or similar tool is simply first passed without interference into the pass-through hole 20 formed in the upper integrated connection 15 of the single front foot 13. Said tip is then inserted into the hole 21 of the single rear foot 16 in the upper connection 17 and this drives the regulation mechanism in height of the rear foot 16.

The provision of a pass-through hole 20 in the single integrated upper connection 15 of the single front foot 13 represents a guide and provides a safe and correct support for the tip of the long-stemmed screwdriver 22 or similar tool towards the rear foot. This simplifies every adjustment operation of the rear foot also in extremely restricted spaces.

This provision also allows the elimination of any additional element that serves to guarantee the correct direction or orientation of the screwdriver towards the rear foot, that must be present in the known additional systems in the form of a guide or the like, fixed to the bottom of the furniture.

The adjustment of the front feet 13 is then effected in the usual way, using a common screwdriver 23 inserted in grooves 24 of the lower adjustable part 14 with respect to an integrated upper connection 15 by means of rotation.

Figure 2:
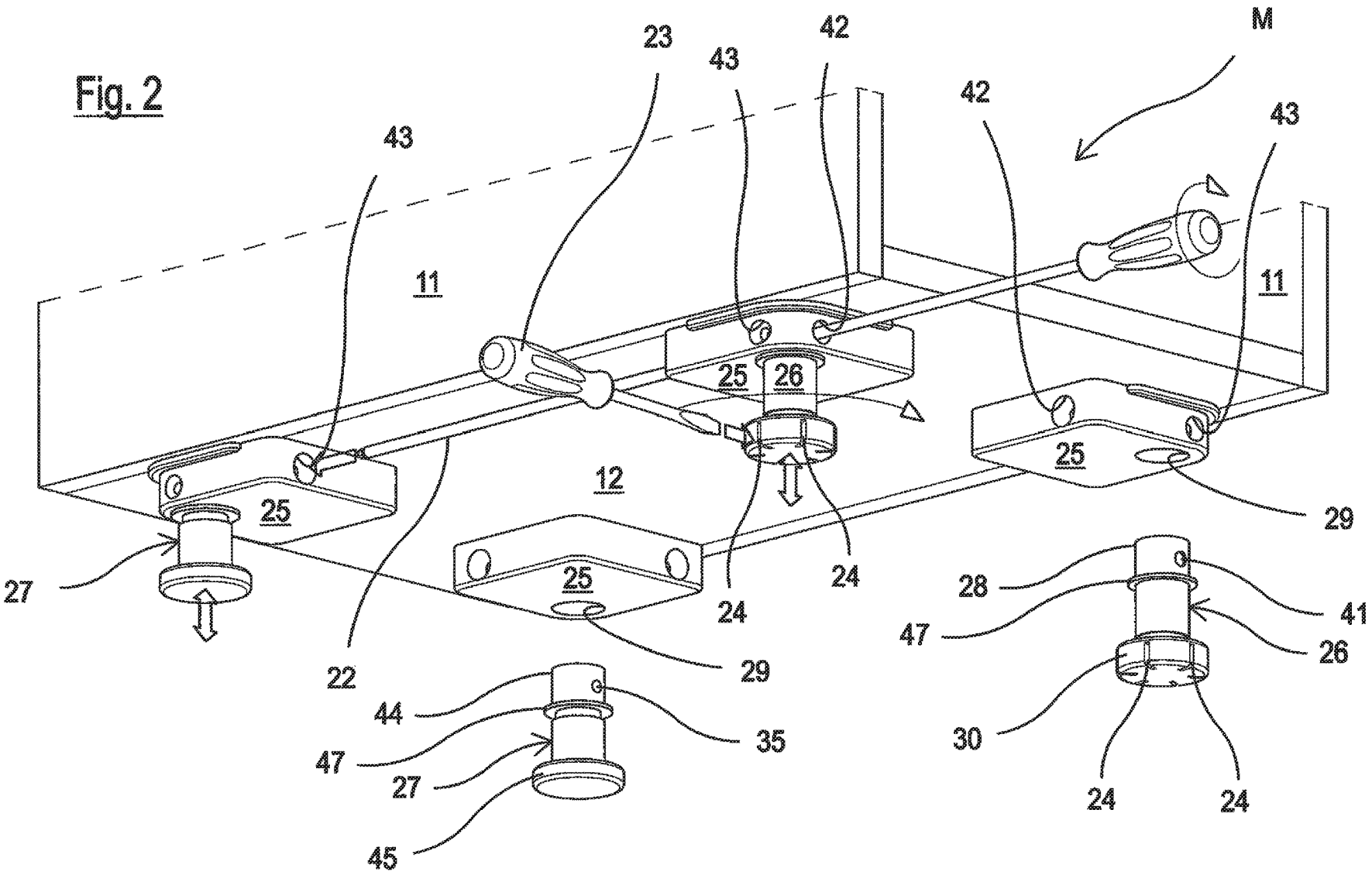
FIG. 2 is a perspective view, with some exploded feet, illustrating a further example of a regulation system according to the invention with a rear foot separated from the connection containing a regulation mechanism, and a front foot, also separated from the connection, with direct regulation by rotation.
Figure 3:
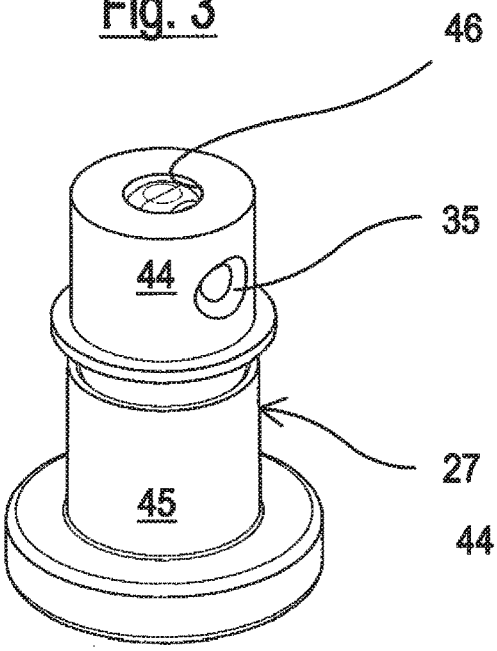
FIGS. 3 to 7 are enlarged views of a single rear foot of FIG. 2 showing it in a perspective view, in a raised view, in a plan view from above and two sectional views.
Figure 4:
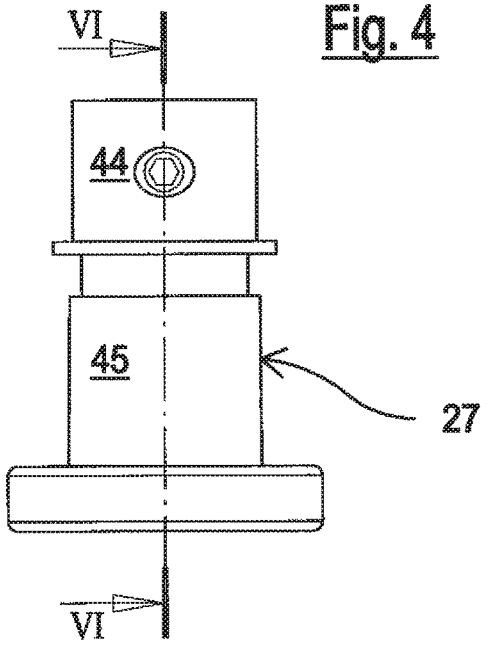
Figure 5:
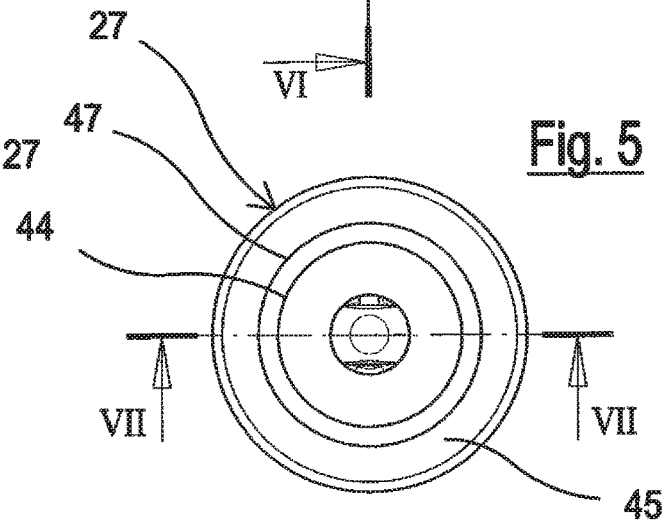
Figure 6:
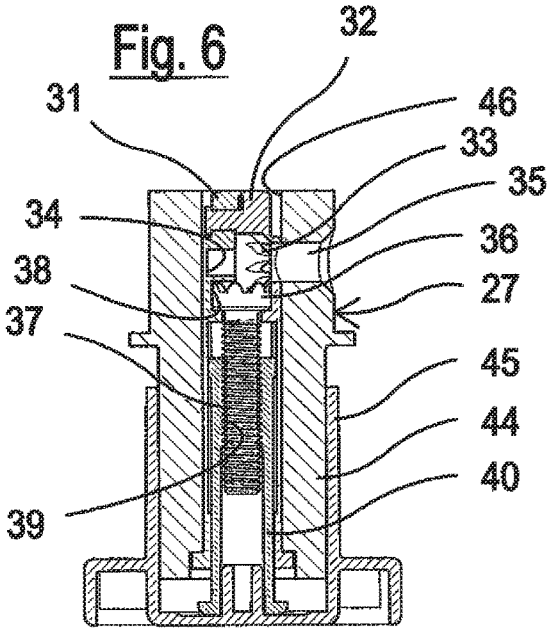
Figure 7:
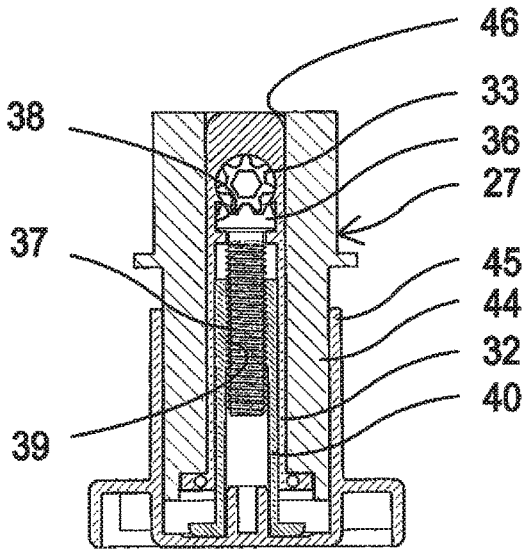

FIG. 2 shows a further embodiment of a regulation system according to the invention, in which the same elements have the same reference numbers.

In a perspective view applied beneath a bottom 12, in fact, plaques or connections 25 are positioned, the same for all four feet, separate and insertable in the same, i.e. two front feet 26 and two rear feet 27.

Each front foot 26 has an upper part 28 which can be inserted in a housing 29 of the plaque 25, and a lower part 30 adjustable in height by means of rotation, as seen for the example of FIG. 1 with the help of a screwdriver 23.

It should be noted that, according to the invention, the upper part 28 of the front foot 26 has a pass-through hole 41 from one side to the other in its part that is inserted in the plaque 25. Said pass-through hole 41 is aligned with a pass-through hole 42 from one side to the other formed in the body of the plaque 25 close to the housing 29 of the foot 26 (in the example of FIG. 2 the left front foot of the piece of furniture). It should also be noted that a further pass-through hole 43 is also provided, formed in the body of the plaque 25 at 90° with respect to the previous hole, when the same plaque 25 is assembled on an opposite edge of the furniture M for housing the opposite front right foot.

Rear feet 27 equipped with a regulation mechanism are also provided. FIGS. 3 to 8 illustrate an example of this type of rear foot 27 which shows the relation between an upper part 44 and a lower part 45 of the rear foot 27. It is in fact provided that a casing in two half-shells 31, 32 be positioned in a body of the upper part 44 in an axial pass-through hole 46 (vertical in the figures), said casing containing a pinion-toothed crown bevel. A pinion 33 is rotatingly positioned inside a hole 34 formed in one of the two half-shells 31, which is aligned with a horizontal holing 35 of the body of the upper part 44. The pinion 33 engages with a toothed crown 36, formed as head of a threaded screw 37, and rotatable in a seat 38 formed in the two coupled half-shells 31 and 32. The threaded screw 37 is in turn positioned in a threaded axial hole 39 and inside a tubular element 40 integral with the lower part 45 of the rear supporting foot 27 on a floor. This lower part 45 of the foot 27 is arranged sliding and adjustable in height with respect to the upper part 44.

These components so to speak define a leveling group which cooperates in correctly positioning the piece of furniture with respect to the floor or supporting surface by acting on the rear foot 27.

The hole 35 of the body of the upper part 44 of the rear foot 27 is positioned aligned with the pass-through hole 43 provided in the plaque 25 positioned at the rear for housing the left rear foot in FIG. 2.

The rear foot 27 is housed in the housing 29 of the plaque 25 so that the hole 35 is aligned with the hole 43 of the plaque 25. In this way, the tip of a long-stemmed screwdriver 22 or similar tool inserted in the hole of the plaque 25 is inserted in the hole 35 of the rear foot 27 and drives the regulation mechanism of the rear foot 27 itself so as to actuate a regulation in height of the rear foot 27. The same occurs identically and symmetrically for the right rear foot 27 which is shown exploded in FIG. 2.

Figure 8:
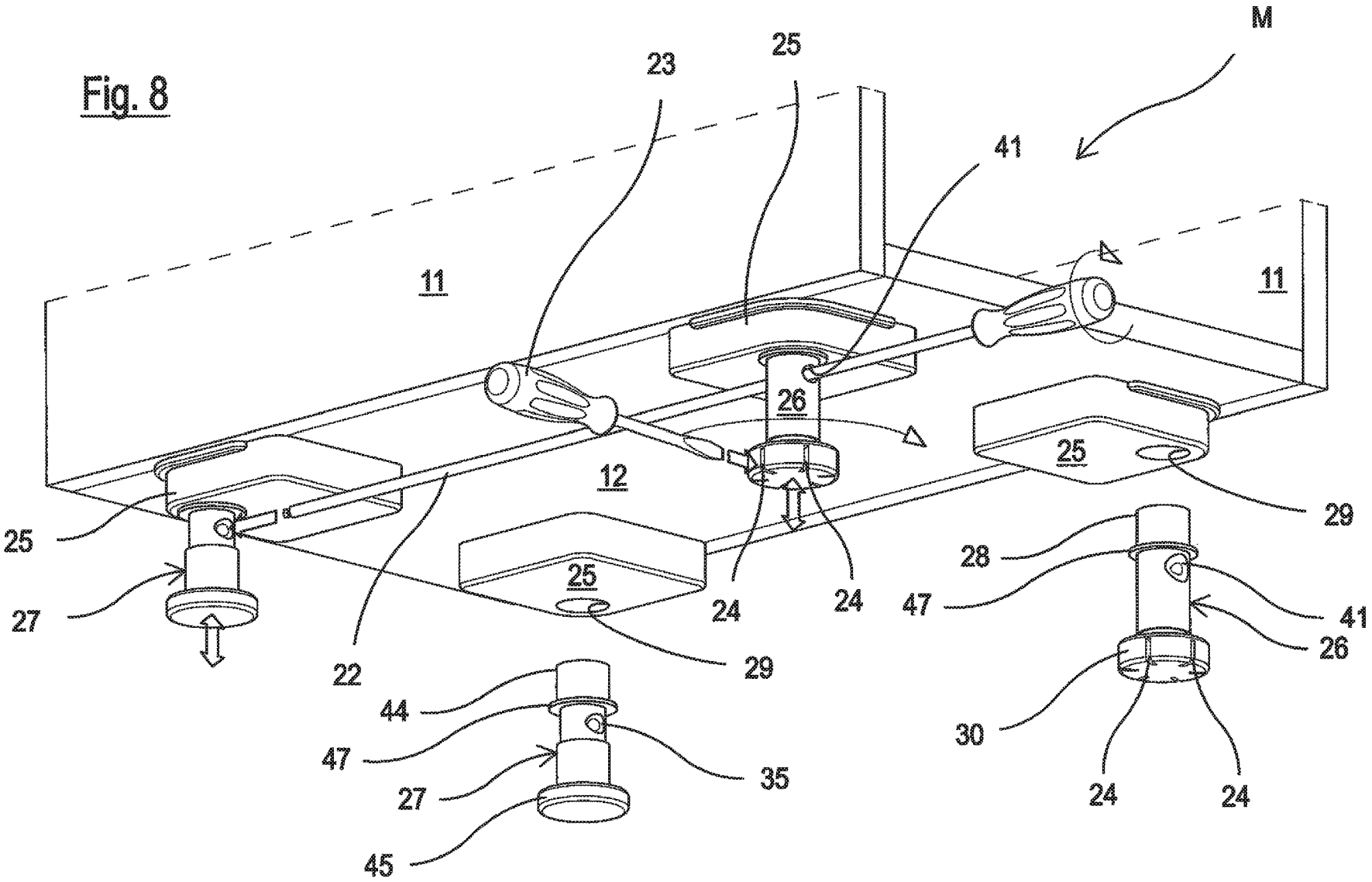
FIG. 8 is a perspective view, with some exploded feet, illustrating a further example of a regulation system according to the invention similar to that of FIG. 2.

FIG. 8 is a perspective view, with some exploded feet, which illustrates a further example of a regulation system according to the invention similar to that of FIG. 2. This further example, where the same elements have the same reference numbers, provides, as a variant, that the plaque 25 does not have pass-through or actuation holes of the regulation mechanism.

The pass-through hole 41, in fact, passes from one side to the other in the front foot 26, in a lower area with respect to that in which it passed in the example of FIG. 2. More specifically, it passes beneath an abutment flange 47 with respect to the plaque 25 which determines the correct positioning of the front foot 26 or rear foot 27 as preferred, in the respective housing 29 of the plaque 25. Said abutment flange 47 was also present in the example of FIG. 2 in which the pass-through hole 41 of the front foot 26 was positioned above the same and above the hole 35 of the rear foot 27.

In this way, with the formation of the holes 35 and 41 beneath the abutment flange 47, there is no need for making holes in the plaques 25.

The regulation of the rear feet 27 is effected as for the first embodiment example shown in FIG. 1 with the introduction of the tip of the long-stemmed screwdriver 22 or similar tool, in the hole 41 of the front foot 26, beneath the flange 47, and with the subsequent adjustment action through the hole 35, beneath the flange 47, in the rear foot 27.

Figures 9, 9A:
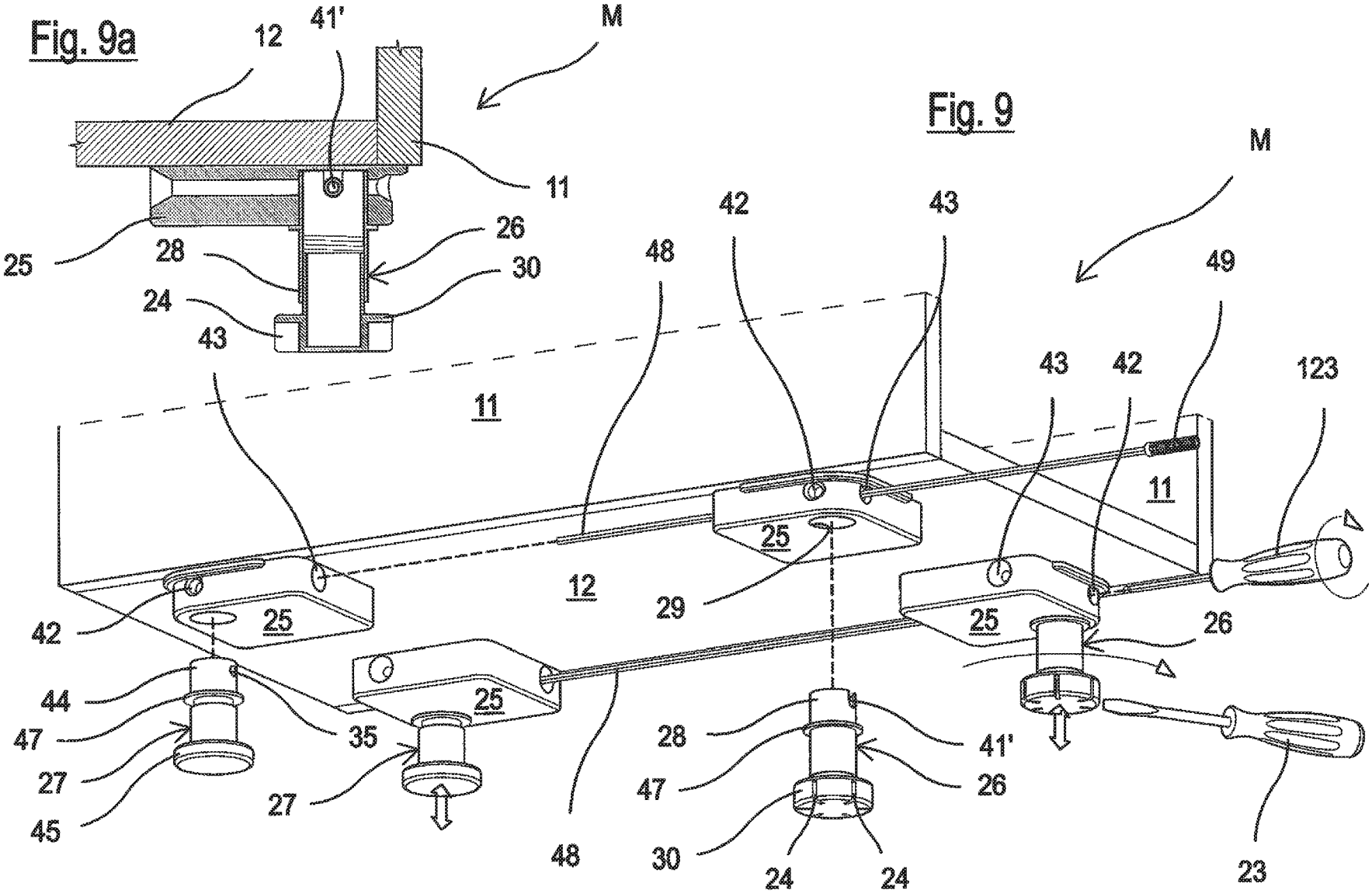
FIG. 9 is a perspective view, with some exploded feet, illustrating a further example of a regulation system according to the invention similar to that of FIG. 2 with extension rods for the rear foot.
FIG. 9*a* is a sectional view of a detail of the system of FIG. 9.

FIG. 9 is a perspective view, with some exploded feet, which illustrates a further example of a regulation system according to the invention. This embodiment has the same numbers for the same elements and is similar to that of FIG. 2 with the provision of an extension rod or transmission rod 48 for actuating the rear foot 27. The transmission rod 48 has an end seat 49 for a tip of a screwdriver 123 having a hexagonal tip for hexagonal seats.

Said transmission rod 48 is passed through a pass-through hole 42 of the plaque 25 to be positioned in the hole 43 to actuate the regulation mechanism of the rear foot 27. FIG. 9*a* is a sectional view of a detail of the system of FIG. 9 in correspondence with the front foot 26.

In this case, it can be seen how the upper part 28 of the front foot 26 has a pass-through groove 41' in its part that is inserted in the plaque 25.

The transmission rod 48 is blocked in said pass-through groove 41' to allow the adjustment of the rear foot 27.

Figures 10, 10A:
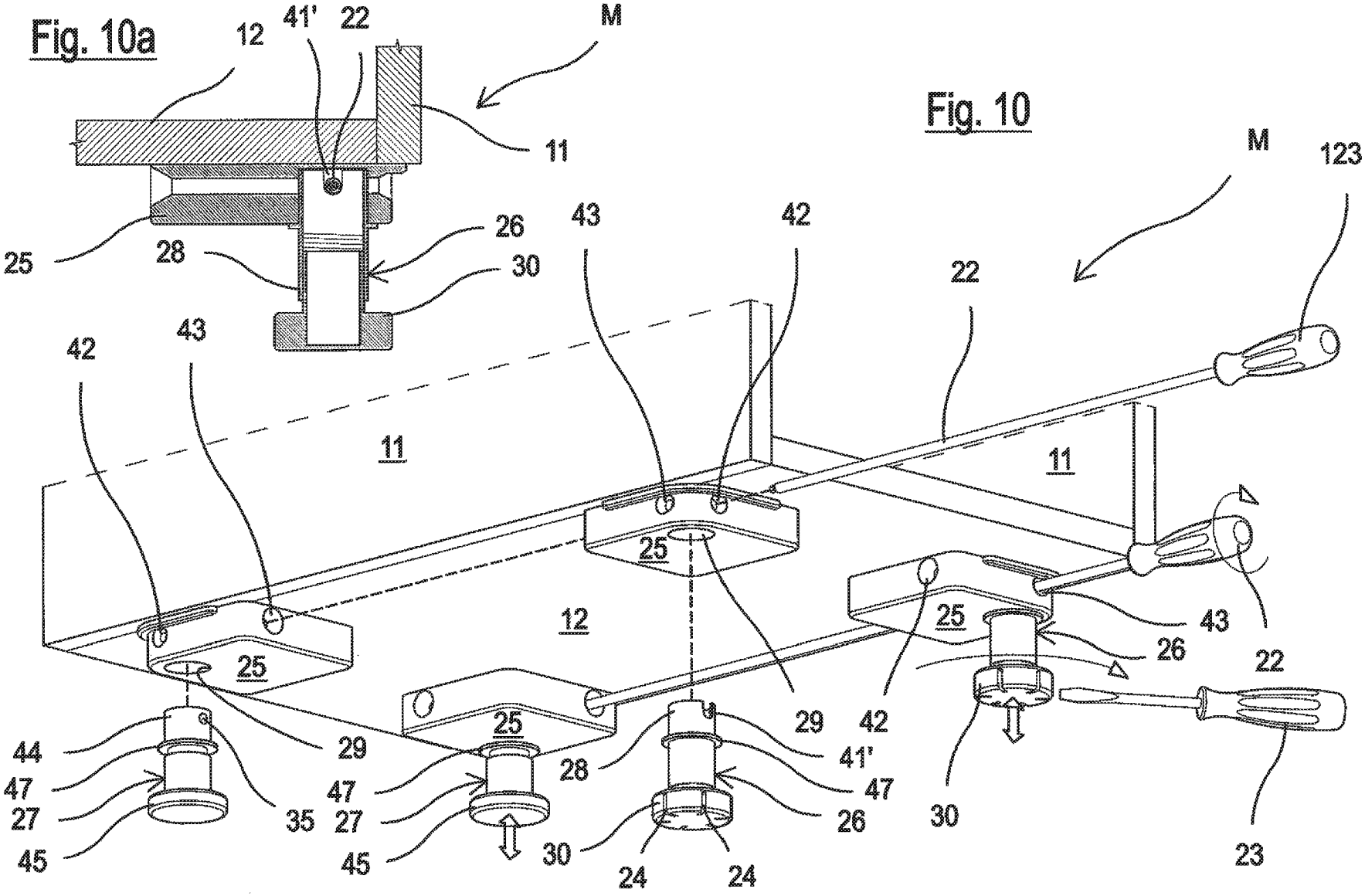
FIG. 10 is a perspective view, with some exploded feet, illustrating a further example of a regulation system according to the invention similar to that of FIG. 2.
FIG. 10*a* is a sectional view of a detail of the system of FIG. 10.
Figures 11, 12, 13, 14:
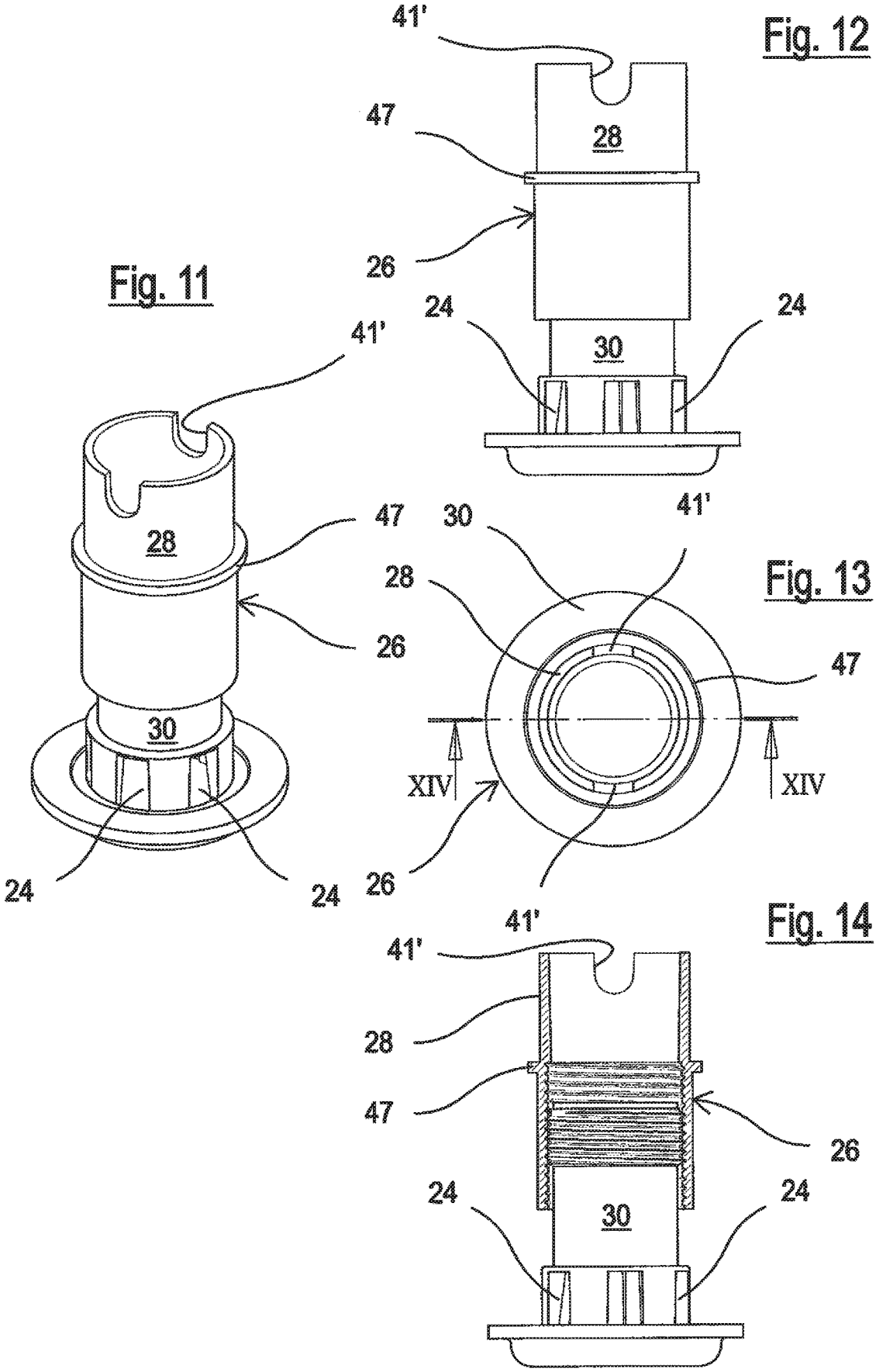
FIGS. 11 to 14 are enlarged views of a single front foot of FIG. 10 showing it in a perspective view, raised view, plan view from above and sectional view.

The embodiment illustrated in FIGS. 10 and 10*a* has the same numbers for the same elements and is similar to that illustrated in both FIGS. 2 and 9.

Unlike FIG. 2, in fact, it has grooves 41' as in FIG. 9 instead of holes 41.

Furthermore, the holes 42 and 43 provided in the plaques 25 are pass-through holes from one side to the other for the passage of a tip of a long-stemmed screwdriver 22 or similar tool for the adjustment of the rear foot 27. The tip or stem of the screwdriver 22 therefore also passes through the grooves 41' of the front feet 26.

FIGS. 11 to 14 show the front foot 26 provided with grooves 41' in the upper part 28 of its body.

Finally, unlike what has so far been illustrated and described, FIGS. 15, 15*a*, 16 and 16*a* show embodiments of regulation systems according to the invention with rear and front feet separated from the connection or plaque 25 and both provided with a regulation mechanism (shown as RM1 and RM2 in FIG. 1). Also in this case, the same elements of the system have the same reference numbers.

In some respects, these examples are similar to those described and illustrated in FIGS. 9, 9*a* and 10, 10*a*, except for the fact indicated above, that the front feet are also provided with an internal regulation mechanism in height.

Figures 15, 15A:
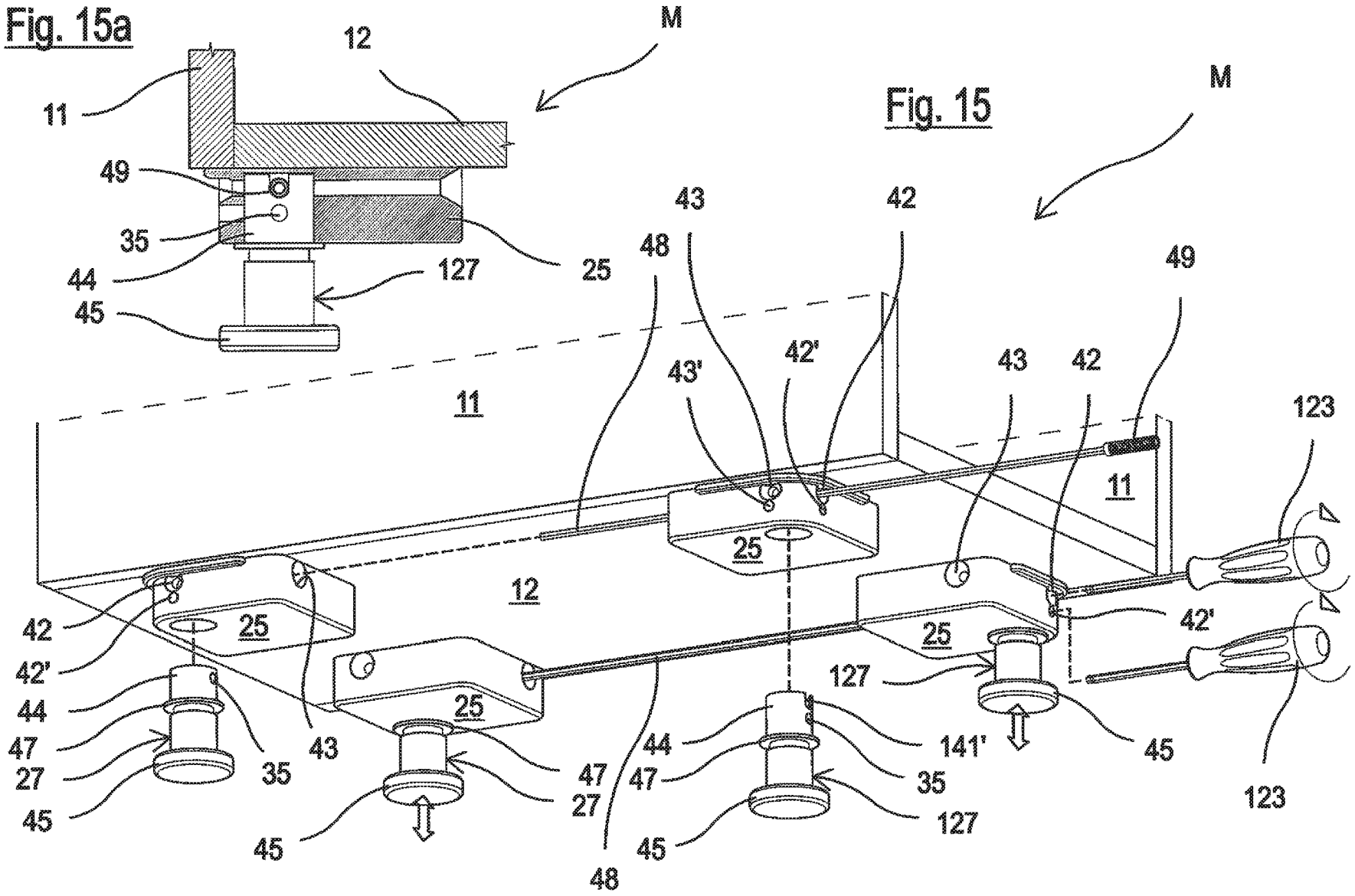
FIGS. 15 and 16 are perspective views illustrating further examples of a regulation system according to the invention with rear and front feet separated from the connection and both provided with a regulation mechanism and FIGS. 15*a* and 16*a* are sectional views of a detail of the system of FIGS. 15 and 16.

With respect to the example of FIGS. 15, 15*a*, it can be seen that the difference with respect to FIGS. 9, 9*a* consists in the fact that front feet 127 are modeled on the feet 27 illustrated in FIGS. 3 to 7 with an upward extension of their upper part 44. A groove 141' is formed therein, in which transmission rods 48 are housed and pass, actuated by a screwdriver 123.

The regulation mechanism of the foot is actuated through the hole 35 underlying the groove 141'.

Furthermore, the hole 35 of the rear foot 27 allows the adjustment of said foot.

It can also be seen that a hole 42', 43' must be produced in the plaques 25, under the holes 42, 43 for the passage of the screwdriver 123 which effects the adjustment of the front foot 127.

Figures 16, 16A:
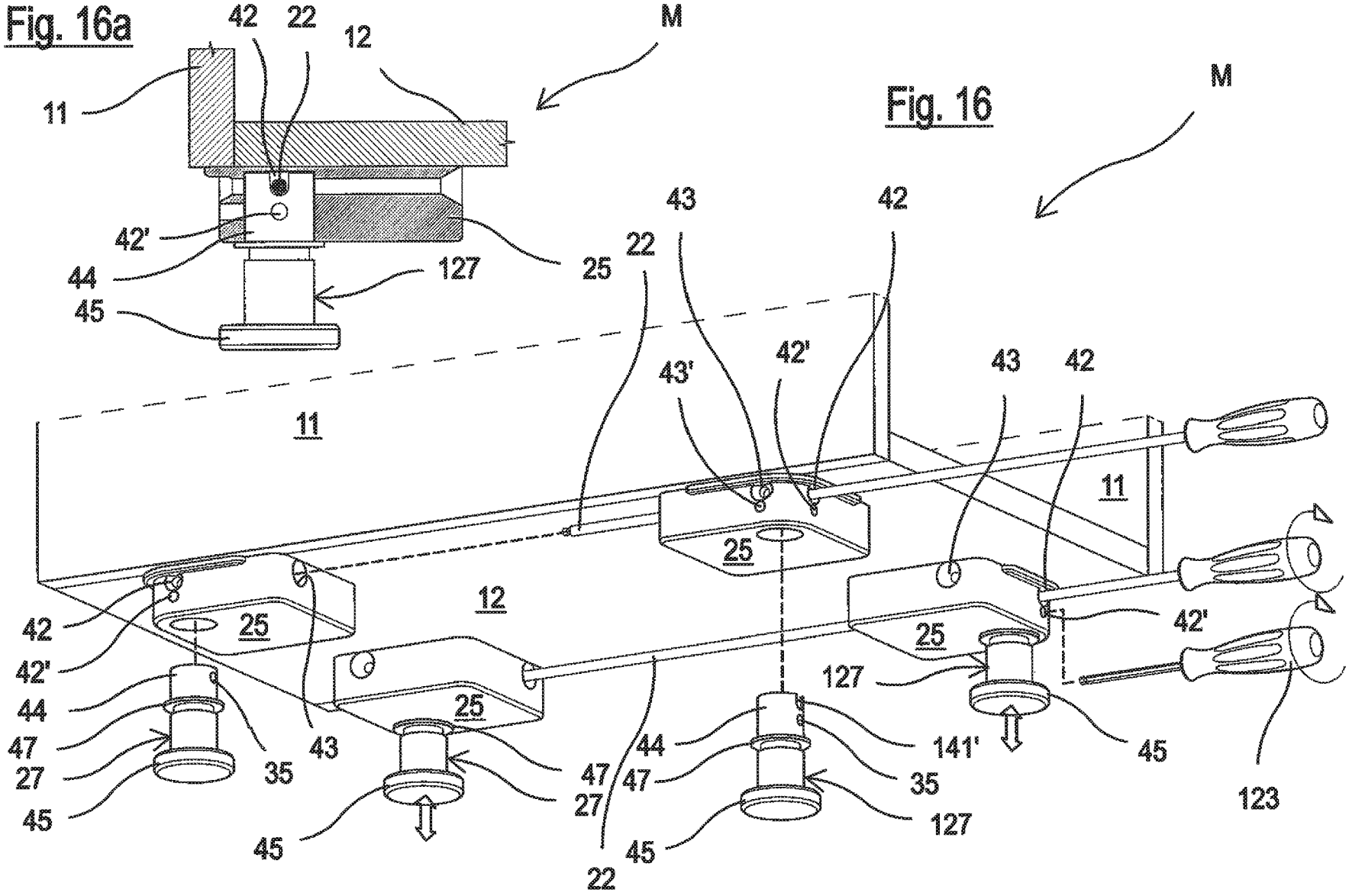

With respect to the examples of FIGS. 16, 16*a*, it can be seen that there is no constructive difference with respect to the example illustrated in FIGS. 15, 15*a* except that the transmission rods have been eliminated.

In this case, the actuation of the rear feet is effected directly by means of the screwdriver 22, whereas the actuation of the front feet is effected with the screwdriver 123 having a hexagonal tip which passes into the underlying holes 42'.

It can thus be seen that the tip of the screwdriver 22 previously described for the actuation of the rear foot 27 is housed and passes in the aligned grooves 141'.

The groove 141' is therefore superimposed with respect to the actuation hole 35 of the mechanism of the foot.

In conclusion therefore, the system according to the present invention solves the problems arising from the known systems used.

Furthermore, the regulation systems for the rear feet are advantageously and significantly simplified by providing a compact front regulation.

The provision of a pass-through hole in general in the connection or even in the body of the foot provides a guide and safe and correct support for the tip of the long-stemmed screwdriver 22 or similar tool that actuates the adjustment of the rear foot. In this way, all regulation operations of the rear foot are simplified even in extremely restricted spaces.

This provision also allows the elimination of any additional element that serves to guarantee the correct direction or orientation of the screwdriver that must be present in the known additional systems in the form of a guide or the like, fixed to the bottom of the furniture.

The adjustment of the front feet is then effected in the usual way, using a common screwdriver.

In the embodiment examples of the invention illustrated in the figures, the furniture M is provided with a pair of front feet and a pair of rear feet. The principles of the invention, however, can also be applied to a piece of furniture M equipped with only one front foot and one rear foot, consequently also to a piece of furniture M equipped with at least one front foot and at least one rear foot.

Furthermore, as can be clearly seen in the figures, the openings of the inlet holes of the screwdriver or similar maneuvering tool are flared in order to facilitate the rapid and correct introduction of the tool itself.

Finally, in the text, the term "foot" may be used for indicating the foot alone, or the foot and its connection to the bottom of the furniture, whether said connection be integrated (in one piece) with the foot itself, or separate from the same.

The objectives mentioned in the preamble of the description have therefore been achieved.

The protection scope of the present invention is defined by the enclosed claims.

The invention claimed is:

1. A compact front regulation system for leveling feet of a piece of furniture having a bottom and shoulders, comprising, in combination:

at least one front foot;

at least one rear foot; and a regulation tool, wherein the at least one rear foot comprises a regulation mechanism in height which is accessible and maneuverable from outside the front regulation system with the regulation tool, wherein the at least one front foot has a pass-through hole that is open and configured to slidably receive therein, from one side to another side, and to have slidably removed therefrom, a stem of the regulation tool of the at least one rear foot, and wherein the pass-through hole provides a support and a guide for the stem of the regulation tool when the regulation tool is moved towards the at least one rear foot, the stem crossing the pass-through hole without interference.

2. The compact front regulation system according to claim 1, wherein the at least one front foot consists of a pair of front feet, and the at least one rear foot consists of a pair of rear feet.

3. The compact front regulation system according to claim 1, wherein each of the at least one front foot and each of the at least one rear foot comprises an integrated connection and the pass-through hole is formed in the integrated connection of the front foot.

4. The compact front regulation system according to claim 3, wherein the at least one front foot is regulated directly by rotating an adjustable lower part of the at least one front foot.

5. The compact front regulation system according to claim 1, further comprising connections that are provided and applied beneath the bottom, wherein one of the connections receive the at least one front foot and the at least one rear foot, which are adapted to be inserted in the one of the connections, and wherein the pass-through hole of the front foot is produced as a pass-through hole in a respective connection.

6. The compact front regulation system according to claim 5, wherein the pass-through hole for the regulation tool of the rear foot is shaped as a pass-through groove in a leg of the at least one front foot.

7. The compact front regulation system according to claim 6, wherein a regulation hole is defined beneath the pass-through groove of the at least one front foot.

8. The compact front regulation system according to claim 5, wherein the front foot has a second regulation mechanism disposed inside the front foot.

9. The compact front regulation system according to claim 5, further comprising an extension rod positioned in the pass-through hole of the respective connection.

10. The compact front regulation system according to claim 1, wherein the regulation tool comprises a screwdriver and an extension rod, the extension rod being configured to be actuated by the screwdriver and providing a portion of the stem of the regulation tool.

* * * * *